US011525458B2

(12) United States Patent
Hinrichs et al.

(10) Patent No.: US 11,525,458 B2
(45) Date of Patent: Dec. 13, 2022

(54) CONVEYING DEVICE

(71) Applicant: HANON SYSTEMS EFP DEUTSCHLAND GMBH, Bad Homburg v. d. Höhe (DE)

(72) Inventors: Jan Hinrichs, Friedrichsdorf (DE); Tobias Kaiser, Frankfurt am Main (DE)

(73) Assignee: HANON SYSTEMS EFP DEUTSCHLAND GMBH, Bad Homburg v. d. Höhe (DE)

( * ) Notice: Subject to any disclaimer, the term of this patent is extended or adjusted under 35 U.S.C. 154(b) by 0 days.

(21) Appl. No.: 17/261,198

(22) PCT Filed: Aug. 29, 2019

(86) PCT No.: PCT/DE2019/200105
§ 371 (c)(1),
(2) Date: Jan. 19, 2021

(87) PCT Pub. No.: WO2020/043248
PCT Pub. Date: Mar. 5, 2020

(65) Prior Publication Data

US 2021/0270288 A1 Sep. 2, 2021

(30) Foreign Application Priority Data

Aug. 31, 2018 (DE) ..... 10 2018 214 805.8

(51) Int. Cl.
*F04D 29/42* (2006.01)
*F04D 15/00* (2006.01)
(Continued)

(52) U.S. Cl.
CPC ..... *F04D 29/4293* (2013.01); *F04D 15/0027* (2013.01); *F04D 29/426* (2013.01); *F04D 29/486* (2013.01); *F04D 29/628* (2013.01)

(58) Field of Classification Search
CPC .. F04D 29/4293; F04D 29/426; F04D 29/628; F04D 13/06; F04D 15/0027; F04D 29/466; F04D 29/486
See application file for complete search history.

(56) References Cited

U.S. PATENT DOCUMENTS 2,936,745 A 5/1960 Frank
3,162,128 A 12/1964 Horlen
(Continued)

FOREIGN PATENT DOCUMENTS

BE 626877 A 1/1963
CN 103569363 A 2/2014
(Continued)

OTHER PUBLICATIONS

Chinese Office Action regarding Chinese Application No. 2019800465620, dated Jan. 6, 2022.
(Continued)

*Primary Examiner* — Dominick L Plakkoottam
(74) *Attorney, Agent, or Firm* — Harness, Dickey & Pierce, P.L.C.

(57) ABSTRACT

A conveying device with an electric drive, having a housing with a suction opening and a plurality of outlet openings that comprises a conveying element which is rotatably received in the housing to produce a fluid flow from the suction opening to the respective outlet opening, wherein the outlet openings are mounted to the housing at least axially spaced from each other.

7 Claims, 3 Drawing Sheets

(51) Int. Cl.
*F04D 29/48* (2006.01)
*F04D 29/62* (2006.01)

(56) References Cited

U.S. PATENT DOCUMENTS

| | | | | |
|---|---|---|---|---|
| 5,613,846 | A * | 3/1997 | Sommer | F04C 2/32 418/241 |
| 5,938,412 | A * | 8/1999 | Izraelev | A61M 60/422 415/206 |
| 9,243,649 | B2 * | 1/2016 | Fournier | F04D 29/628 |
| 10,247,199 | B2 | 4/2019 | Lee et al. | |
| 2004/0173249 | A1 | 9/2004 | Assmann et al. | |
| 2006/0062679 | A1 * | 3/2006 | Rossman | F04D 29/4293 417/423.1 |
| 2014/0286747 | A1 * | 9/2014 | Fang | F04D 29/486 415/1 |
| 2015/0027575 | A1 * | 1/2015 | Morein | F01P 7/14 137/865 |
| 2016/0120131 | A1 | 5/2016 | Conrad et al. | |
| 2018/0149171 | A1 * | 5/2018 | Geffert | F01P 5/12 |

FOREIGN PATENT DOCUMENTS

| | | | |
|---|---|---|---|
| CN | 204061198 | U | 12/2014 |
| CN | 106050742 | A | 10/2016 |
| CN | 107567546 | A | 1/2018 |
| CN | 107588008 | A | 1/2018 |
| DE | 610726 | C | 3/1935 |
| DE | 1403836 | B1 | 10/1969 |
| DE | 102015106639 | A1 | 11/2016 |
| DE | 102017208134 | A1 | 11/2018 |
| EP | 1635068 | A1 | 3/2006 |
| EP | 3254596 | A1 | 12/2017 |
| WO | 2009070565 | A1 | 6/2009 |
| WO | 2017137175 | A1 | 8/2017 |

OTHER PUBLICATIONS

Chinese Search Report regarding Chinese Application No. 2019800465620, dated Dec. 29, 2021.

* cited by examiner

CONVEYING DEVICE

CROSS-REFERENCE TO RELATED APPLICATIONS

This application is a U.S. National Phase Application under 35 U.S.C. 371 of International Application No. PCT/DE2019/200105, filed on Aug. 29, 2019, which claims the benefit of German Patent Application No. 10 2018 214 805.8, filed on Aug. 31, 2018. The entire disclosures of each of the above applications are incorporated herein by reference.

FIELD

The disclosure relates to a conveying device having a housing with an inlet opening and a plurality of outlet openings that comprises a conveying element which is rotatably received in the housing to produce a fluid flow from the suction opening to the respective outlet opening, wherein a ring element is provided radially outside the conveying element inside the housing, by means of which the fluid flow through the respective outlet opening is adjustable.

BACKGROUND

This section provides background information related to the present disclosure which is not necessarily prior art.

There are different conveying devices in vehicles for a variety of fluids such as air, water, oil or mixtures thereof.

One example is cooling systems with water pumps, which are used for the cooling of different electrical components of the vehicle. These are hybrid or purely electric vehicles since vehicles with internal combustion engines do not comprise any electrical components that need to be cooled. Valves are used to ensure the distribution of the refrigerant.

The valves each require an actuator with electrical control and a holder on a component of the vehicle, which results in high component costs.

Another example of a conveying means is a compressor that takes in air and makes it available to different consumers. To date, the air flow is also distributed in a valve-controlled manner.

Known from DE 102015106639 A1 is a water pump comprising a housing having an inlet opening and a plurality of outlet openings, that comprises a conveying element which is rotatably received in the housing to produce a fluid flow from the suction opening to the respective outlet opening. In this regard, a rotating ring element is adjusted radially outside the conveying element inside the housing such that the fluid flow through the respective outlet opening can be adjusted. In this regard, a ring element is used which comprises a plurality of spiral-shaped fluid channels.

DE 10 2017 208 134.1, which has not yet been published, describes a radial turbomachine having two outlets and one rotatable volute. The regulation of the partial flows is achieved by covering the volute exit with the two outlets. The degree of coverage can be varied by a rotatory movement. However, the percentage distribution of the partial flows depends on the total volume flow of the pump.

SUMMARY

This section provides a general summary of the disclosure, and is not a comprehensive disclosure of its full scope or all of its features.

The object of the present disclosure is to provide a conveying device which has a simple structure and yet a good adjustability or controllability of different fluid flows without inhibiting the flow.

This object is solved by a conveying device with an electric drive, having a housing with a suction opening and a plurality of outlet openings, that comprises a conveying element which is rotatably received in the housing to produce a fluid flow from the suction opening to the respective outlet opening, wherein the outlet openings are mounted to the housing at least axially spaced from each other.

Owing to the arrangement of the outlet openings, it is possible to divide the fluid volume flow to the outlet openings almost independently of the total volume flow.

It is an advantage that a rotatable ring element is provided radially outside the conveying element inside the housing, by means of which the fluid flow through the respective outlet opening is adjustable.

The additional use of a rotatable ring element allows an even finer and better adjustment of the fluid flow.

According to the disclosure, the conveying device or the ring element comprises an axially mounted parting plate to produce two partial fluid channels for the respective outlet openings which are arranged in an axially offset manner.

Owing to the parting plate, two independent partial flows are achieved.

In an advantageous embodiment, the conveying device is a compressor.

In an alternative embodiment, the conveying device is a fluid pump.

DRAWINGS

The drawings described herein are for illustrative purposes only of selected embodiments and not all possible implementations, and are not intended to limit the scope of the present disclosure.

The disclosure is described below by way of examples with reference to the accompanying drawings.

Corresponding reference numerals indicate corresponding parts throughout the several views of the drawings.

DETAILED DESCRIPTION

Example embodiments will now be described more fully with reference to the accompanying drawings.

Figure 1:
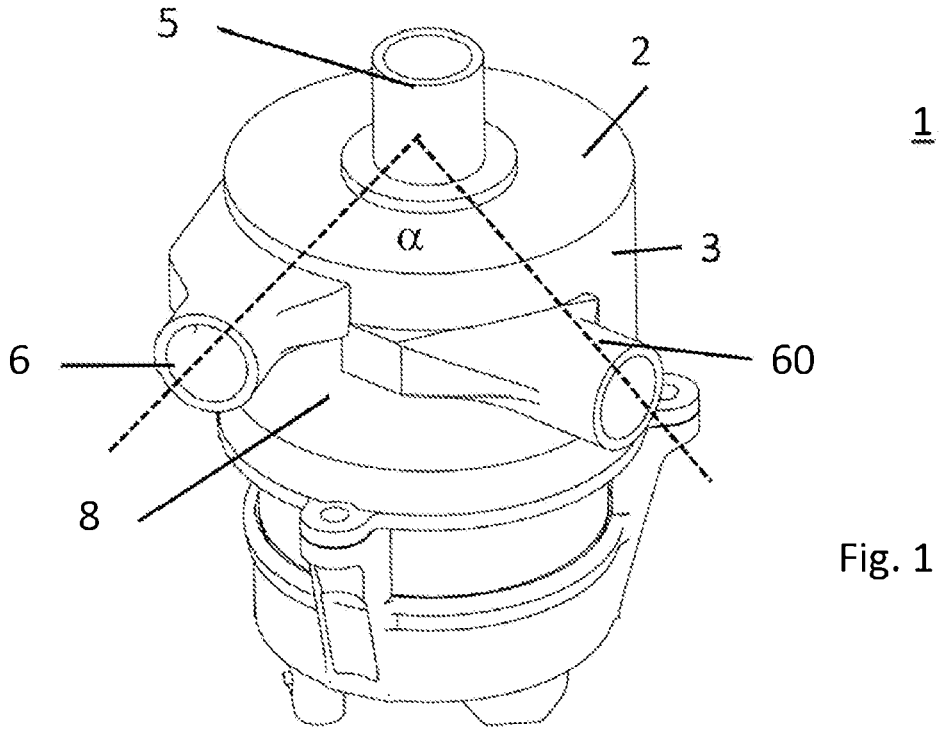
FIG. 1 shows a fluid conveying device according to the disclosure.

FIG. 1 shows one embodiment example of a conveying device 1 according to the disclosure. This embodiment example is a water pump. However, the disclosure can also be applied to a compressor.

The conveying device 1 comprises a housing 2 having a first housing part 3 as housing pot and a second housing part 4 as housing base for receiving an electric motor. The second housing part 4 is mounted to the first housing part 3 such that it can be closed and sealed.

Figure 2:
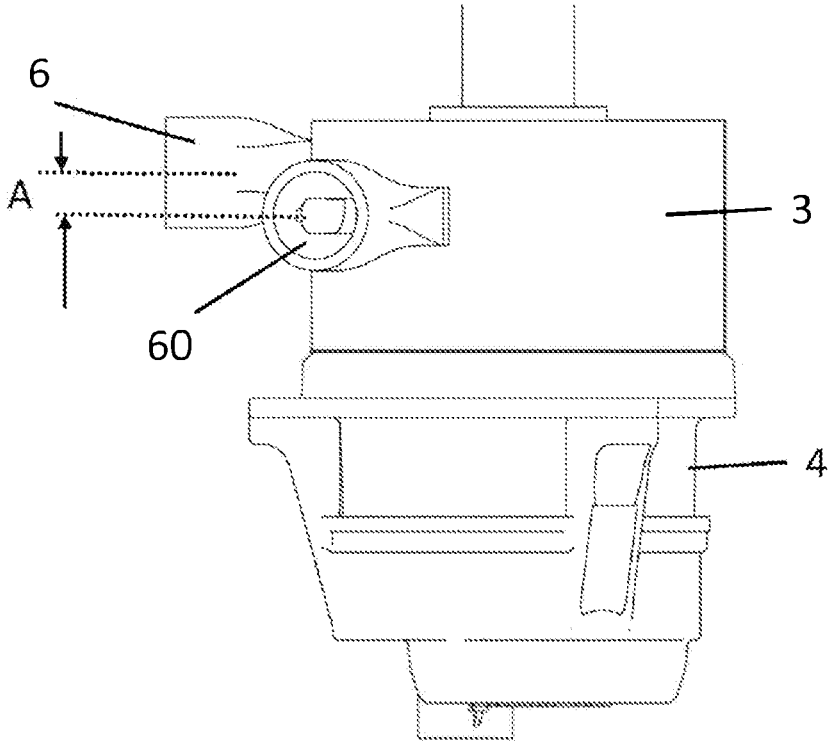
FIG. 2 shows a sectional view of the conveying device according to FIG. 1.

The housing 2 comprises a suction opening 5 for sucking in a fluid, in this example water. The suction opening 5 is positioned centrally to the rotary axis of the conveying device. The housing 2 also comprises two outlet openings 6 and 60 for letting out the conveyed water or fluid. The housing 2 is formed essentially cylindrically and comprises a peripheral wall 8. In this regard, the outlet openings 6 in the peripheral wall 8 are arranged to be spaced apart from each other. The two pump outlets are axially offset from each other such that the centers of the outlet openings 6 and 60, as shown in FIG. 2, are axially spaced from each other at distance A. In addition, the centers are radially spaced from each other by an angle alpha, which is marked very schematically in FIG. 1.

The suction opening 5 is located on the top side of the first housing part.

Figure 3:
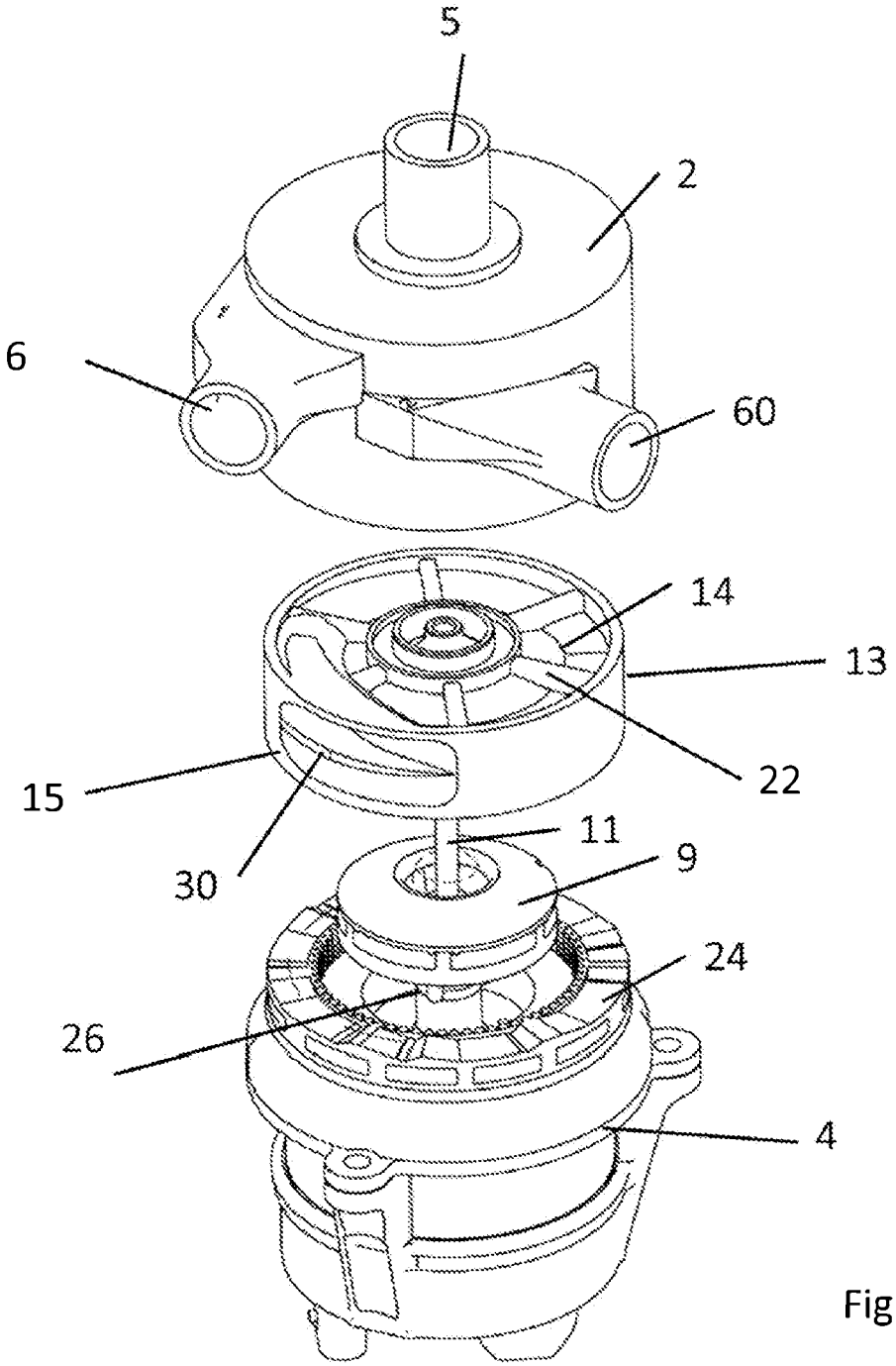
FIG. 3 shows an exploded view of one embodiment example of a fluid conveying device according to the disclosure, FIGS. 4 and 5 each shows a section through the pump part of the conveying device.

A partial flow is supplied to each pump outlet, as described by FIG. 3.

A pump wheel or compressor wheel 9, configured to be rotatable, is provided in the housing 2. An electric drive acting on a drive shaft 11 is thereby provided. By rotating the pump wheel or compressor wheel 9, a fluid flow is generated from the suction opening 5 to the outlet openings 6, 60.

Furthermore, an adjustable ring element 13 is provided radially outside the pump wheel or compressor wheel 9 inside the housing 2, by means of which the fluid flow through the respective outlet opening 6, 60 can be adjusted. The ring element 13 comprises webs 22 extending radially from the center outward that are used for stiffening. The peripheral wall 20 is a cylindrical wall with an opening 15. The opening 15 in the peripheral wall 20 is an elongated area extending along a radial angle section. However, in this embodiment example, this angular section of the peripheral wall is smaller than the angle alpha between the pump outlets 6, 60.

The adjustable ring element 13 comprises, for example, a fluid channel 14 spirally extending from radially inside to radially outside, which opens radially outside into an opening 15.

According to the disclosure, the fluid channel 14 is divided by a parting plate 30 which axially divides the flow into two partial flows. This type of dividing is largely independent of the volume flow. The respective partial flows are each connected to only one outlet 6, 60.

The fluid channel 14 is radially open on the inside and communicates with the pump wheel or compressor wheel 9 in order to be able to receive the fluid flow from the pump wheel or compressor wheel 9. The webs 22 do not affect the flow through the fluid channel. The radially inner area of the ring element 13 is located radially outside the pump wheel 9, and the ring element 13 receives the compressor wheel 9 in a central recess 16.

If the ring element 13 rotates in the housing 2, fluid communication can be achieved by covering the opening 15 with one of the outlet openings 6, 60, and this results in a fluid flow on the outlet side.

As an alternative to an alternating opening of the two outlets, it is also possible to generate a fluid flow through two outlets at the same time by means of closely adjacent outlets and a partial covering of the outlets, by making the angle alpha smaller than the radial angle section of the opening 15.

A mechanism for turning the ring element is explained in detail in the application DE 10 2017 208 134.1 which has not yet been laid open.

The internal components of the feed pump 1 comprise a stator 24 fitted in the second housing part 3. The stator 24 surrounds a rotor 26. The rotor 26 and the stator 24 are separated from each other by a magnetic air gap.

The rotor 26 comprises a drive shaft 11 and a pump wheel 9 for moving a liquid when the liquid enters the suction opening 5. The pump wheel 9 moves the liquid through the outlet 6, 60 to the respective consumers.

Figure 4:
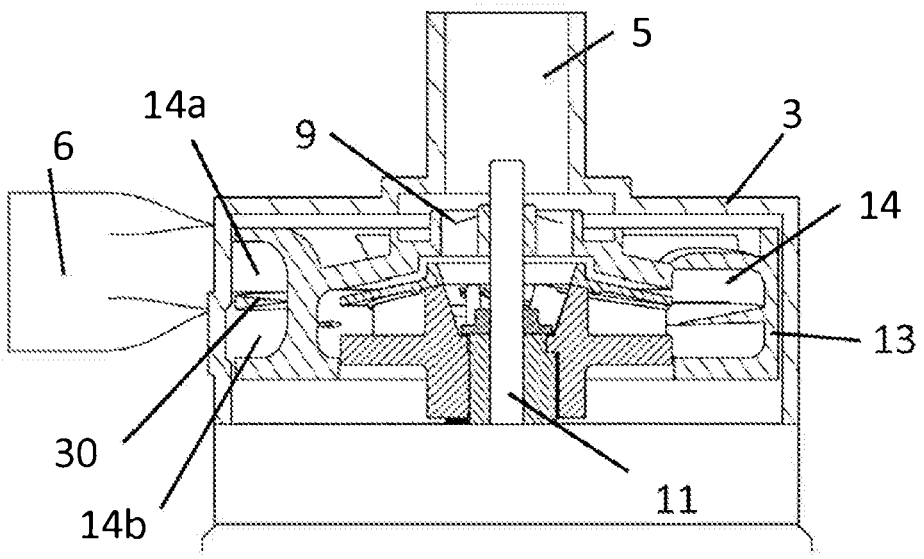
Figure 5:
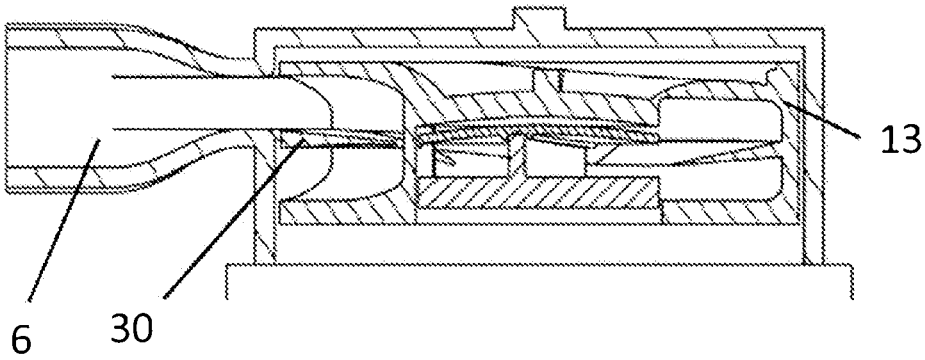

FIGS. 4 and 5 are sections through the first housing part 3. The ring element 13 is axially divided into two partial fluid channels 14*a* and 14*b* by the parting plate 30.

The concept according to the disclosure can be used both in feed pumps with an adjustment via an adjustment ring, i.e. a ring element 13, and also in feed pumps without an adjustment.

To operate such a feed pump without an adjustable ring element, valves would then still be required at the exit side of the outlets.

The foregoing description of the embodiments has been provided for purposes of illustration and description. It is not intended to be exhaustive or to limit the disclosure. Individual elements or features of a particular embodiment are generally not limited to that particular embodiment, but, where applicable, are inter-changeable and can be used in a selected embodiment, even if not specifically shown or described. The same may also be varied in many ways. Such variations are to be regarded as a departure from the disclosure, and all such modifications are intended to be included within the scope of the disclosure.

The invention claimed is:

1. A conveying device with an electric drive, having a housing with a suction opening and a plurality of outlet openings, comprising:

a conveying element which is rotatably received in the housing to produce a fluid flow from the suction opening to the respective outlet opening, wherein the outlet openings are mounted to the housing and axially spaced from each other; and a rotatable ring element positioned radially outside the conveying element and inside the housing, the rotatable ring element including an axially mounted parting plate producing two partial fluid channels, wherein the rotatable ring element is operable to adjust the fluid flow through the respective outlet opening.

2. The conveying device according to claim 1, wherein the outlet openings extend tangentially outwards to the suction opening.

3. The conveying device according to claim 1, wherein the outlet openings are distributed at a radially external peripheral wall in the circumferential direction and arranged at a distance to each other.

4. The conveying device according to claim 1, wherein the suction opening is arranged concentrically to the rotary axis of the conveying device.

5. The conveying device according to claim 1, wherein the adjustable ring element is adjustable in the circumferential direction.

6. The conveying device according to claim 1, wherein the conveying device is a compressor.

7. The conveying device according to claim 1, wherein the conveying device is a liquid pump.

* * * * *